United States Patent [19]

Taneda et al.

[11] Patent Number: 5,046,235

[45] Date of Patent: Sep. 10, 1991

[54] METHOD OF AND APPARATUS FOR ASSEMBLING A TRANSFORMER CORE

[75] Inventors: Yukinori Taneda, Yokohama; Sei Hoshizawa, Shibata; Katsuya Nagayama; Tatsukichi Matsuura, both of Tokyo, all of Japan

[73] Assignees: Hitachi, Ltd.; The Tokyo Electric Power Co., Ltd., both of Tokyo, Japan

[21] Appl. No.: 654,665

[22] Filed: Feb. 13, 1991

[30] Foreign Application Priority Data

Jul. 4, 1990 [JP] Japan ..... 2-175244

[51] Int. Cl.[5] ..... H01F 41/02

[52] U.S. Cl. ..... 29/606; 29/609; 29/738; 29/744; 29/760

[58] Field of Search ..... 29/606, 609, 738, 744, 29/760, 761

[56] References Cited

U.S. PATENT DOCUMENTS 4,734,975 4/1988 Ballard et al. ..... 29/606

FOREIGN PATENT DOCUMENTS 63-241911 10/1988 Japan .

*Primary Examiner*—Carl E. Hall

*Attorney, Agent, or Firm*—Antonelli, Terry, Stout & Kraus

[57] ABSTRACT

A method of assembling a transformer core in which a lamination of rectangular plates formed of a magnetic material is inserted in the spaces in primary and secondary transformer coils, and in which the opposite ends of the lamination are brought into abutment each other to form the lamination into an annular shape. The lamination of the magnetic material plates is bent into a U-like shape with the transformer coils thereon and is magnetized by energizing the transformer coils, while the opposite ends of each magnetic material plate are restrained from being brought closer to each other. The opposite ends of the laminated magnetic material plates are successively released from the restrained state from the innermost opposed ends of the U-like shape to attract and closely contact each other by the magnetic force. The method is carried out with an apparatus having a flat plate on which the lamination of magnetic material plates is placed, a pair of guide plates having parallel vertical surfaces and used to support the magnetic material plates so that the plates are maintained in the state of being bent in the U-like shpae, a pair of pressing members for restraining the opposite end portions of each magnetic material plate from being brought closer to each other, a driver for moving the pair of pressing members step by step toward the open end of the U-like shape; and a device for magnetizing the end portions of the U-shaped magnetic material plates by energizing the transformer coils.

11 Claims, 6 Drawing Sheets

METHOD OF AND APPARATUS FOR ASSEMBLING A TRANSFORMER CORE

BACKGROUND OF THE INVENTION

This invention relates to method and apparatus for assembling a transformer core based on inserting a lamination of rectangular plates formed of a magnetic material (e.g., silicon steel plates or amorphous magnetic alloy bands) in spaces defined in transformer coils formed of windings of primary and secondary coils, and bringing the opposite ends of the magnetic material lamination into abutment with each other to form the lamination into an annular shape.

A transformer core assembly technique such as the one disclosed in Japanese Patent Unexamined Publication No. 63-241911 is known.

FIG. 5 shows a state in which laminated core 1 is inserted in coils 2*a* and 2*b*. The core 1 is formed into an annular shape as shown in FIG. 6.

FIG. 7 shows an enlarged cross section of a portion VII shown in FIG. 6. The smaller the gap G between abutting opposite end portions 1*l* and 1*r* of the laminated magnetic material, plates of the core 1 are, more improved the crossing of lines of magnetic force over the connected portions is, so that the performance of the transformer is improved.

FIG. 8 shows in an enlarged scale the details of the opposite end portions of laminated magnetic material plates constituting the core 1 in its manufacturing step shown in FIG. 5.

The above-described well-known technique had a problem of occurrence of large gaps between abutting portions of laminated plates with a resultant increase in the resistance to the magnetic circuit because the abutment-lamination assembly step which influences the core performance was conducted by a manual operation. Further, a core formed of an amorphous magnetic alloy had a drawback that the material becomes brittle during a pretreatment step, i.e., core annealing step, so that the core tends to crack or break to deteriorate its characteristics. There are further problems in the manual assembling operation; two operators are required for the assembling operation because the core and the coils are heavy, and the operation speed is reduced in order to avoid deteriorations in the characteristics pointed out above, resulting in an increase in the assembly cost.

SUMMARY OF THE INVENTION

It is an object of the present invention to provide a method and apparatus for assembling a transformer core which can perform automatic abutment-lamination operations even in the case where the core is formed of an amorphous magnetic material, and which make it possible to fabricated a high-performance core in which the abutment gaps are minimized.

The basic principle of the present invention created to achieve this object resides in that in the arrangment shown in FIG. 5, the coils 2*a* and 2*b* are electrically energized to magnetize the laminated magnetic material plates (core) 1 so that the opposite ends thereof attract and contact each other by the magnetic force and thus are connected together as shown in FIG. 6.

To realize this magnetic attraction in a practical manner, it is necessary to make the multiplicity of laminated magnetic material plates successively attract and contact each other in a good order. To apply the above principle to practical use in consideration of these circumstances, according to the present invention, there is provided a method of assembling a transformer core in which a lamination of rectangular plates formed of a magnetic material is inserted in spaces defined in windings of primary and secondary transformer coils, and in which the opposite ends of the magnetic material lamination are the brought into abutment with each other to form the lamination into an annular shape, said method comprising the steps of:

bending the lamination of the rectangular magnetic material plates into a U-shape while the lamination of the magnetic material plates extends through the transformer coils;

magnetizing the magnetic material plates by electrically energizing the transformer coils, while restraining the opposite end portions of the U-shaped lamination of the magnetic material plates so as to prevent said end portions from being brought closer to each other;

successively releasing the opposite end portions of the U-shaped lamination of the magnetic material plates from being restrained from the insides; and causing the released opposite end portions of the U-shaped lamination of the magnetic material plates to attract and closely contact each other by the magnetic force.

The apparatus arranged to carry out this method of the invention includes:

a flat plate on which the lamination of the rectangular magnetic material plates is placed such that the side surfaces of the magnetic material plates at the major side of the rectangle are in abutment with said flat plate;

a pair of guide plates having parallel vertical surfaces, said guide plates supporting the lamination of the rectangular magnetic material plates so that the magnetic material plates are maintained in a state of being bent in a U-like shape;

a pair of pressing members for restraining the opposite end portions of the magnetic material plates bent in the U-like shape from being brought closer to each other;

drive means for moving said pair of pressing members step by step toward the open end of the U-like shape; and means for magnetizing the magnetic material plates by electrically energizing the transformer coils.

According to the above method, the opposite end portions of magnetized rectangular plates of a magnetic material are connected by being brought into abutment against each other by magnetic attraction.

The restrained opposite end portions of the laminated magnetic material plates are successively released from the innermost opposed ends, so that the ends of the released magnetic material plates successively attract and contact each other and are regularly brought into abutment on each other.

The assembly operation can be automatically performed and is not laborious since the open ends of the core are bent and connected by magnetic attraction.

The apparatus constructed as described above has components necessary and sufficient for carrying out the method of the invention, whereby the invention can be carried out easily and positively to fully exhibit its effects.

DESCRIPTION OF THE PREFERRED EMBODIMENT

Figure 1:
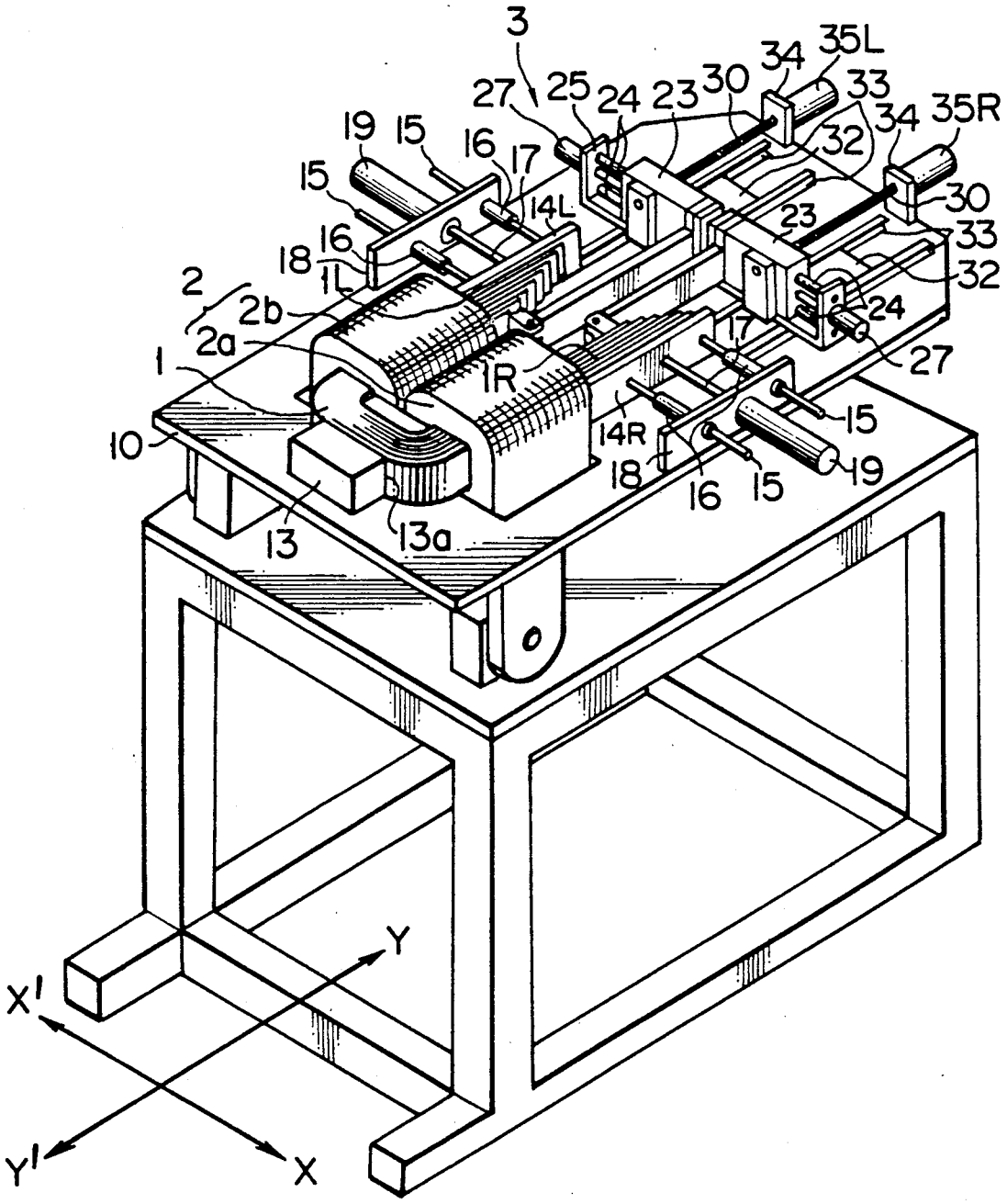
FIG. 1 is a perspective view of an embodiment of an apparatus constructed in accordance with the present invention to carry out the method of the invention.

For convenience of description, two horizontal axes X and Y perpendicular to each other as shown in FIG. 1 are assumed, and the direction of an arrow X is assumed as the right while the direction of an arrow X' is assumed as the left.

Figure 2:
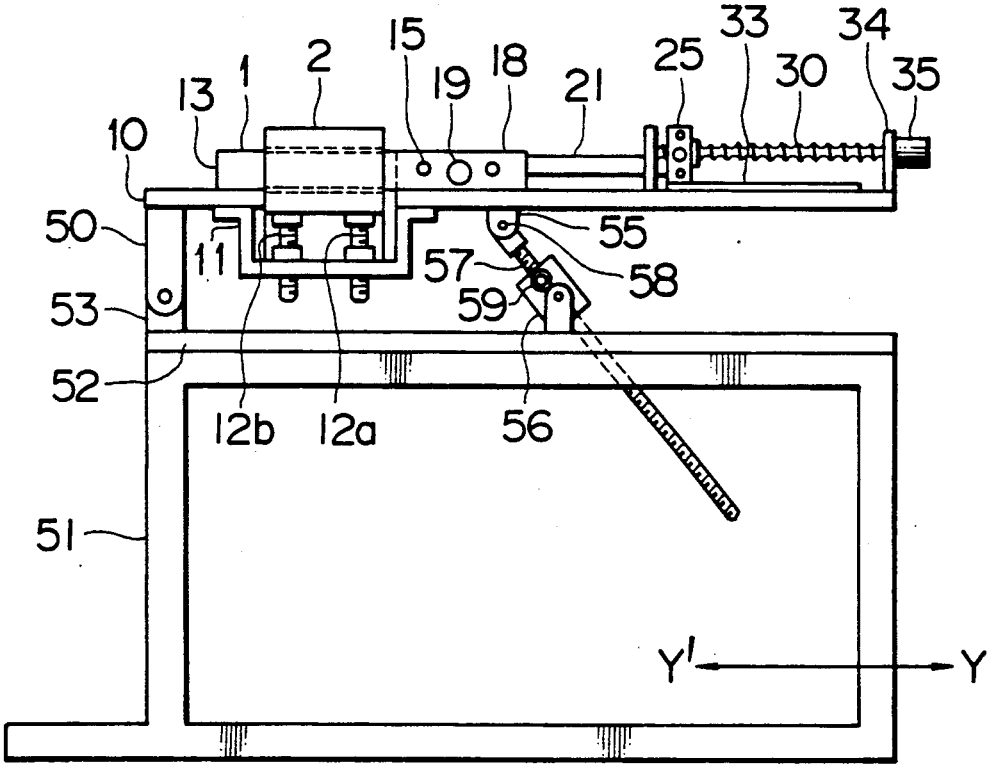
FIG. 2 is a side view of an important part of the apparatus shown in FIG. 1.
Figure 3:
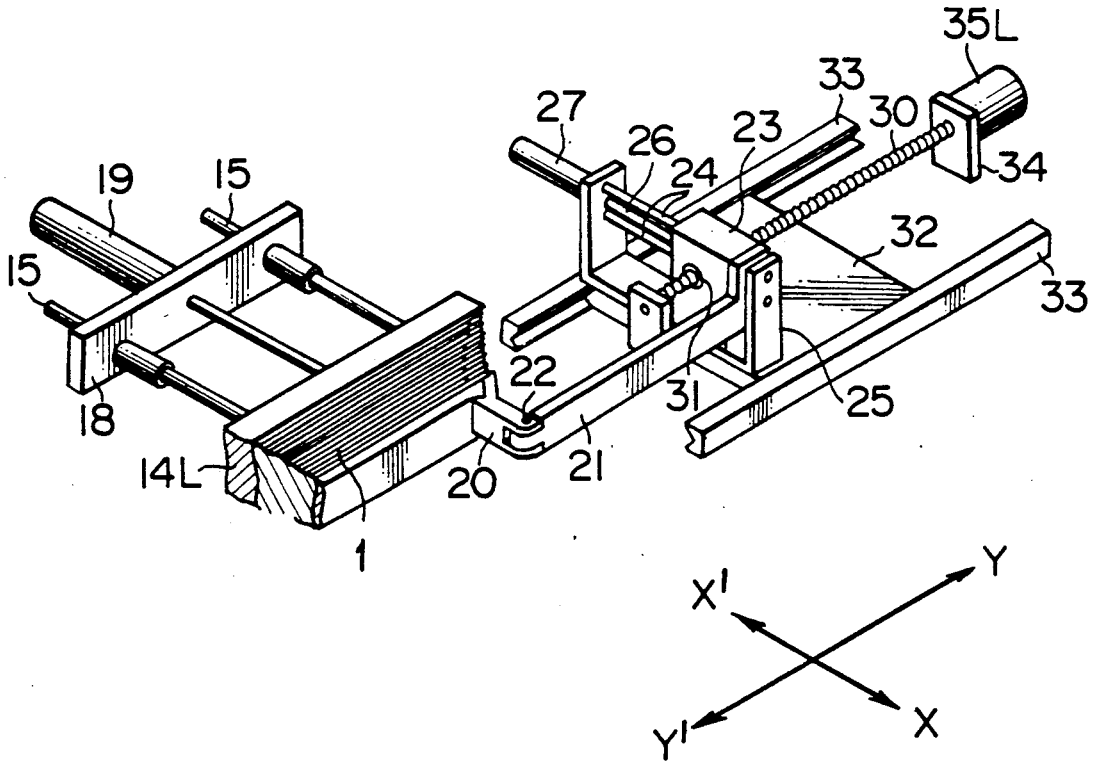
FIG. 3 is a perspective view of a half of the important part of the apparatus shown in FIG. 2.

FIG. 2 is a side view of essential components of an assembly apparatus 3 shown in FIG. 1 taken in the direction of the arrow X', and FIG. 3 is a perspective view of such components.

As shown in FIG. 2, jacks 12*a* and 12*b* are mounted on a bracket 11 fixed to a plate 10 and serve to support coils 2 so as to prevent the weight of a core 1 placed on the plate 10 from being applied to the coils 2.

The core 1 is placed on the plate 10 with its major sides in contact with the plate 10. A pinching block 13 for restraining the core 1 from moving is fixed to the plate 10 according to the size and the position of the core 1. A channel 13*a* is formed in the pinching block 13. A central portion of the core bent into a "U" is fitted in the channel 13*a* and restrained thereby. Abutting portions $\mathbf{1}_R$ and $\mathbf{1}_L$ of the core 1 project out of the coils 2 and are supported from the left and right by a pair of spaced guide plates $\mathbf{14}_R$ and $\mathbf{14}_L$ so as to be prevented from being deformed outward. Slide bars 15 are fixed to the guide plates 14 and are slidablely guided by slide bushes 16. A cylinder rod 17 is attached at its inner end to each guide plate 14. The cylinder rod 17 can be extended or retracted by a cylinder 19 fixed to a bracket 18. The guide plates 14 are arranged to facilitate the assembly operation by retracting the cylinder rods 17 to increase the distance between the guide plates 14 when the core 1 and the coils 2 are set on the assembly apparatus 3.

A mechanism for holding the open ends of the core 1 will be described below with reference to FIGS. 1 to 3. FIG. 3 shows the left half of the mechanism since this embodiment of the apparatus is symmetric with respect to the longitudinal center line shown by the axis Y.

Figure 8:
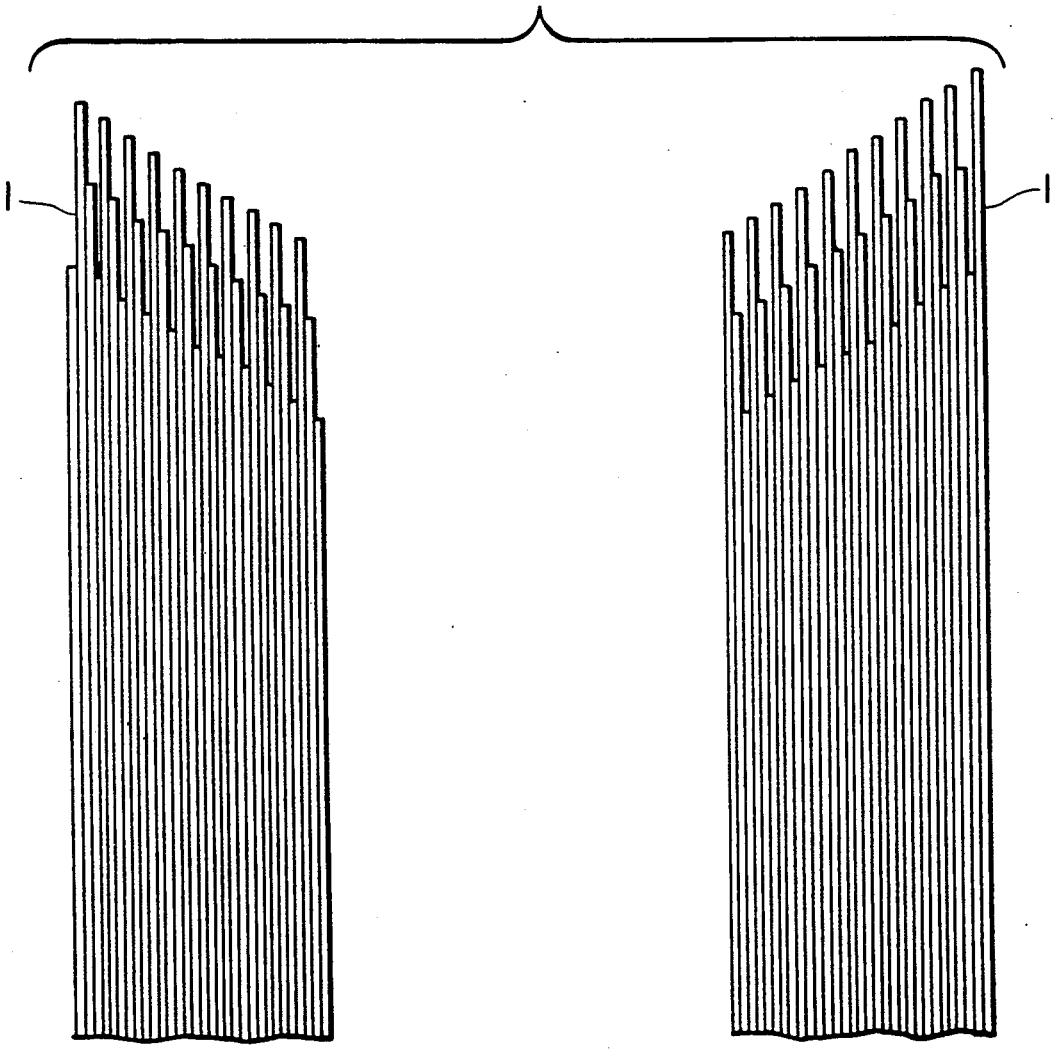
FIG. 8 is an enlarged schematic illustration of the end portions of the core shown in FIG. 5.

At the open ends of the core 1, groups of core sheets each consisting of one or a plurality of sheets are arranged as shown in FIG. 8. Therefore, when the core 1 is retrained at a desired longitudinal position thereof by a claw 20, the parts of the core sheets located inwardly of the claw 20 are released. One end of a bar 21 is fixed to the claw 20 by a pin 22, while the other end of the bar 21 is fixed to a slide block 23. Guide bars 24 are disposed so as to extend through the slide block 23. The guide bars 24 are fixed to a generally U-shaped bracket 25. An inner end of a cylinder rod 26 is secured to the slide block 23. The slide block 23 can be slidably moved in the bracket 25 along the guide bars 24 by a cylinder 27 fixed to the bracket 25. The bracket 25 is fixed to a nut 31 threadably engaged with a ball screw 30 and to a slide table 32 which can be moved along V guides 33. The slide block 23 can therefore be moved in the axial direction of the ball screw 30. The rotating shaft of a stepping motor 35 fixed to a bracket 34 is secured to one end of the ball screw 30. Consequently, the nut 31 and slide block 23 guided by the bracket 25 fixed to the slide table 32 and, hence, the bar 21 fixed to the slide block 23 can be moved by the rotation of the stepping motor 35 so that the claw 20 is moved toward the open end of the core 1. Then, the end portion of the core 1 formed of a group of one or a plurality of sheets is disengaged from the claw 20 and released from the restrained state.

Figure 4:
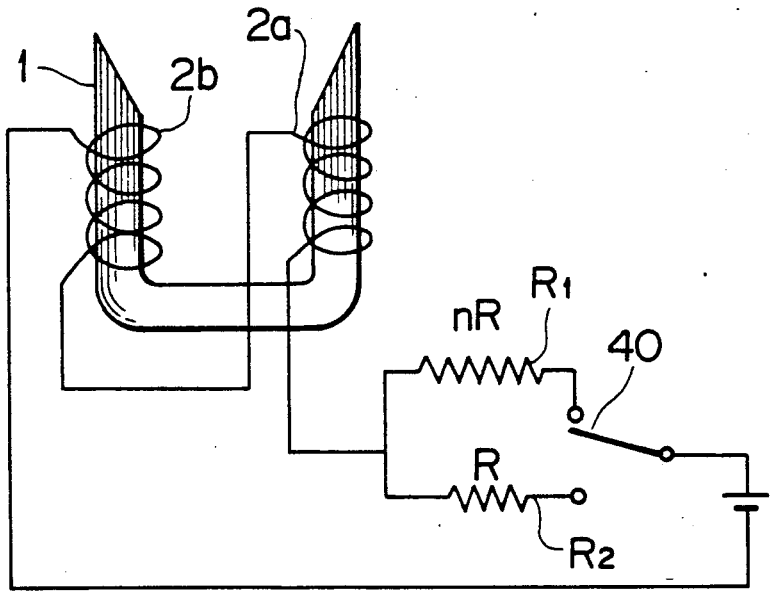
FIG. 4 is a circuit diagram of the electric system of the apparatus shown in FIG. 1.
Figure 5:
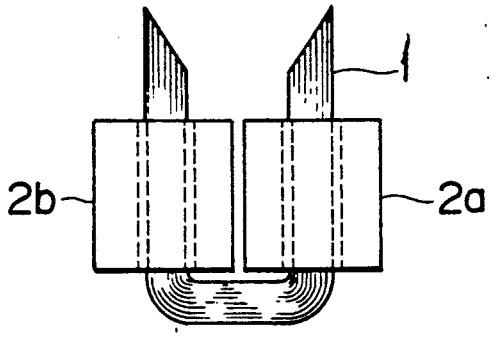
FIGS. 5 and 6 are schematic illustrations of a transformer core.
Figure 6:
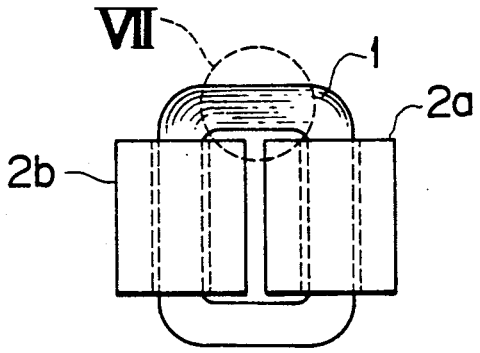
Figure 7:
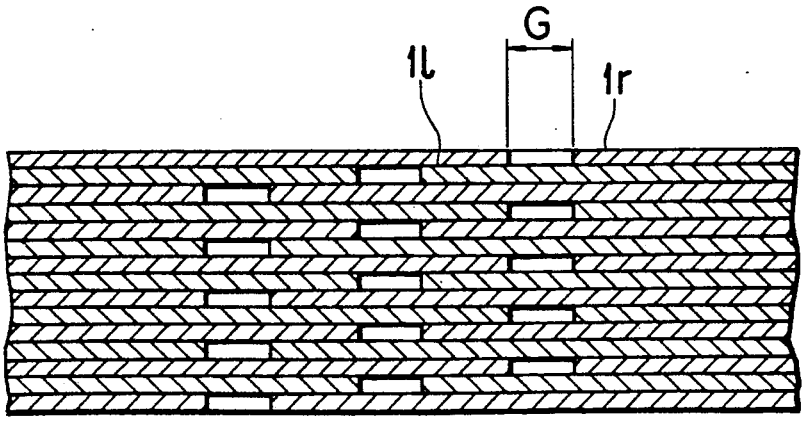
FIG. 7 is a enlarged cross-sectional view of the part VII shown in FIG. 6.

On the other hand, an arrangement such as one shown in FIG. 4 may be used in which, if a current flows through a primary or secondary coil, the open ends of the core 1 are so energized as to have opposite magnetic polarities, and in which when each of the end portions of the core 1 to be assembled or joined together is released from the claw 20 retracted by a controller (not shown), a relay 40 is immediately changed over to switch from a resistor $R_1$ having a large resistance nR to a resistor $R_2$ having a small resistance R so that the current increases by n times.

Another arrangement described below may also be adopted. As shown in FIG. 2, a bracket 50 is fixed to the underside of the plate 10. The plate 10 is pivotally connected through a pin 54 to a bearing block 53 provided on a base plate 52 on a base frame 51. A bracket 55 is fixed to a generally central portion of the underside of the plate 10 and is pivotally connected to a slide shaft 57 of a jack 56 through a pin 58. By the rotation of a handle 59 of the jack 56, the plate 10 can rotate about the pin 54 and rise to a position at a desired angle between 0° and 90° to the horizontal. The force of friction between the plate 10 and the core 1 released by the retraction of the claws 20, which force is based on the weight of the core 1, is thereby reduced, so that the end portions of the U-shaped core 1 can easily be attracted by the magnetic force generated by the magnetic field of the coils 20.

Transformer coils 2 and a U-shaped core 1 extending therethrough are placed on the thus-constructed assembling apparatus. Then, the left and right guide plates $\mathbf{14}_L$ and $\mathbf{14}_R$ are moved by the cylinders 19 inwardly of the core 1 and the slide blocks 23 are similarly moved by the cylinders 27. Thereafter, the stepping motors $\mathbf{35}_R$ and $\mathbf{35}_L$ are operated to move the claws 20 in the direction of the arrow Y' and then the cylinders 27 are operated to urge the core radially outwardly. Next, the coils 2*a* and 2*b* are electrically energized as shown in FIG. 4 and the stepping motor $\mathbf{35}_L$ is rotated to a predetermined extent to retract the left claw 20 in the direction of the arrow Y, thereby releasing a portion of the core 1. Then, the stepping motor $\mathbf{35}_R$ is rotated to a predetermined extent to retract the right claw 20, thereby releasing a corresponding portion of the core 1. These core portions attract each other by the magnetic force generated by the coils 2*a* and 2*b* so as to minimize the distance between them, so that the gaps G between abutting ends of the laminated sheets of the core are minimized. This sequence of operation steps is repeated by the controller (not shown) to effect abutment-lamination assembly of the core 1.

As described above, when the method of the present invention is suitably applied along with the assembling apparatus of the invention, the operation of abutment-lamination of the core can be automatically performed even if the core is formed of an amorphous alloy magnetic material, and the abutment gaps in the core can be minimized, thus providing a high-performance transformer core.

What is claimed is:

1. A method of assembling a transformer core in which a lamination of rectangular plates formed of a magnetic material is inserted in spaces defined in windings of primary and secondary transformer coils, and in which the opposite ends of the magnetic material lamination are brought into abutment on each other to form the lamination into an annular shape, said method comprising the steps of:

bending the lamination of the rectangular magnetic material plates into a U shape while the lamination of the magnetic materiai plates extends through the transformer coils;

magnetizing the magnetic material plates by electrically energizing the transformer coils, while restraining the opposite end portions of the U-shaped lamination of the magnetic material plates so as to prevent said end portions from being brought closer to each other;

successively releasing the opposite end portions of the U-shaped lamination of the magnetic material plates from being restrained from the insides; and causing the released opposite end portions of the U-shaped lamination of the magnetic material plates to attract and closely contact each other by the magnetic force.

2. A method of assembling a transformer core according to claim 1, wherein the transformer coil energizing current is temporarily increased each time a portion of the U-shaped lamination of the magnetic material plates is released from the restrained state.

3. A method of assembling a transformer core according to claim 1, wherein, when portions of the U-shaped lamination of the magnetic material plates are successively released from the state of being restrained at the opposite ends, rectangular side surfaces of the magnetic material plates at the major side of the rectangle are supported on a smooth flat plate.

4. A method of assembling a transformer core according to claim 3, wherein the opposite end portions of the U-shaped lamination of the magnetic material plates are released from the restrained state while the smooth flat plate is inclined about a horizontal axis perpendicular to the center line of the U shape.

5. A method of assembling a transformer core according to claim 1, wherein the transformer coils and the magnetic material plates are supported independently of each other to prevent the weight of the magnetic material plate from being supported by the transformer coils.

6. A method of assembling a transformer core according to claim 1, wherein when the opposite end portions of the magnetic material plates bent in the U shape are successively released from the restrained state, a central portion of the lamination of the magnetic material plates bent in the U shape is restrained.

7. An apparatus for assembling a transformer core in which a lamination of rectangular plates formed of a magnetic material is inserted in spaces defined in primary and secondary transformer coils formed of windings, and in which the opposite end portions of the magnetic material lamination are brought into abutment with each other to form the lamination into an annular shape, said apparatus comprising:

a flat plate on which the lamination of the rectangular magnetic material plates is placed such that the side surfaces of the magnetic material plates at the major side of the rectangle are in abutment on said flat plate;

a pair of guide plates having parallel vertical surfaces, said guide plates supporting the lamination of the rectangular magnetic material plates so that the magnetic material plates are maintained in a state of being bent in a U-like shape;

a pair of pressing members for restraining the opposite ends portions of the magnetic material plates bent in the U-like shape from being brought closer to each other;

drive means for moving said pair of pressing members step by step toward the open end of the U-like shape; and means for magnetizing the magnetic material plates by electrically energizing the transformer coils.

8. An apparatus for assembling a transformer core according to claim 7, wherein said means for magnetizing the transformer coils includes a controller operatively associated with said drive means for moving said pair of pressing members and temporarily increases the energizing current each time when said drive means moves said pressing members.

9. An apparatus for assembling a transformer core according to claim 7, wherein said flat plate on which the magnetic material plates are placed is pivotable about a horizontal axis perpendicular to the center line of the U-like shape of the bent magnetic material plates, and the apparatus further comprises means for driving said flat plate to incline the same.

10. An apparatus for assembling a transformer core according to claim 7, further including means for guiding said pair of guide plates so that said guide plates are moved closer to or away from each other while maintaining the parallelism therebetween and means for driving said guide plates.

11. An apparatus for assembling a transformer core according to claim 7, further including jack means for supporting the transformer coils to adjust the position of the same generally in the vertical direction, said jack means being provided independently of said flat plate on which the magnetic material plates are placed.

* * * * *